US006216557B1

(12) United States Patent
Ishiuchi et al.

(10) Patent No.: US 6,216,557 B1
(45) **Date of Patent: *Apr. 17, 2001**

(54) PUSH ROD, AND PROCESS FOR PRODUCING THE SAME

(75) Inventors: Yukio Ishiuchi; Toshikazu Hamamoto; Michishige Sakai; Makoto Nagata, all of Wako; Hiroshi Waragaya, Toda; Iwao Ishii, Toda; Eiji Kaneko, Toda; Hiroyoshi Ootsuki, Toda, all of (JP)

(73) Assignees: Honda Giken Kogyo Kabushiki Kaisha, Tokyo; Kabushiki Kaisha Hongo, Toda, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 575 days.

(21) Appl. No.: 08/586,806

(22) PCT Filed: Jul. 11, 1995

(86) PCT No.: PCT/JP95/01375

§ 371 Date: Jan. 29, 1996

§ 102(e) Date: Jan. 29, 1996

(87) PCT Pub. No.: WO96/01938

PCT Pub. Date: Jan. 25, 1996

(30) Foreign Application Priority Data

Jul. 12, 1994 (JP) ..... 6-182865

(51) Int. Cl.[7] ..... F01L 1/14

(52) U.S. Cl. ..... 74/579 R; 123/90.61; 29/888.2

(58) Field of Search ..... 74/579 R; 123/90.61, 123/90.62, 90.63; 29/888.2

(56) References Cited

U.S. PATENT DOCUMENTS

| | | | | |
|---|---|---|---|---|
| 2,975,775 | * | 3/1961 | Macura | 123/90.61 |
| 3,066,658 | * | 12/1962 | Gondek | 123/90.61 |
| 3,094,107 | * | 6/1963 | Gondek | 123/90.61 |
| 3,101,402 | * | 8/1963 | Gondek | 29/888.2 X |
| 3,191,290 | * | 6/1965 | Knox | 123/90.61 X |
| 4,317,267 | * | 3/1982 | Usui | 29/888.2 |
| 4,436,063 | * | 3/1984 | Usui | 29/888.2 X |

FOREIGN PATENT DOCUMENTS

| | | | | |
|---|---|---|---|---|
| 55-1446 | * | 1/1980 | (JP) | 29/888.2 |
| 57-8307 | * | 1/1982 | (JP) | 123/90.61 |
| 57-29069 | * | 6/1982 | (JP) . | |
| 57-210111 | * | 12/1982 | (JP) | 123/90.61 |
| 60-55230 | | 12/1985 | (JP) . | |
| 61-163233 | | 7/1986 | (JP) . | |
| 61-279711 | | 12/1986 | (JP) . | |
| 63-47603 | | 12/1988 | (JP) . | |
| 2-81909 | | 3/1990 | (JP) . | |

* cited by examiner

*Primary Examiner*—Mary Ann Green
(74) *Attorney, Agent, or Firm*—Arent Fox Kinter Plotkin & Kahn PLLC

(57) ABSTRACT

A push rod includes a rod body and a steel ball bonded to at least one of end faces of the rod body by an electric resistance welding. The rod body 2 is formed from an aluminum alloy. Thus, it is possible to provide a push rod which is lightweight and which can be produced at an inexpensive cost.

3 Claims, 16 Drawing Sheets

100μm

Al-K $\alpha$ ray image

Fe-K $\alpha$ ray image

PUSH ROD, AND PROCESS FOR PRODUCING THE SAME

FIELD OF THE INVENTION

The present invention relates to a push rod and particularly, to a push rod including a rod body, and a steel ball bonded to at least one of the end faces of the rod body by an electric resistance welding, as well as a process for producing the same.

This push rod is used in a valve-operating mechanism of an internal combustion engine, a friction clutch and the like.

BACKGROUND ART

There is such a conventionally known push rod including a rod body made of a stainless steel pipe material and a steel ball, which are bonded to each other by projection welding (see Japanese Patent Application Laid-open No. 81909/90).

However, the known push rod has a problem that the push rod is heavy in weight and is expensive in manufacturing cost, because the rod body is made of the stainless steel pipe material.

DISCLOSURE OF THE INVENTION

It is an object of the present invention to provide a push rod of the above-described type, which is lightweight and inexpensive in manufacturing cost.

To achieve the above object, according to the present invention, there is provided a push rod comprised of a rod body, and a steel ball bonded to at least one of the end faces of the rod body by electric resistance welding, wherein the rod body is formed from an aluminum alloy.

The rod body of the above-described push rod is formed from an aluminum alloy and therefore, the push rod itself is light in weight and inexpensive in manufacturing cost, as compared with the push rod having the rod body formed from the stainless steel pipe material.

It is another object of the present invention to provide a process for producing a push rod of the above-described type, wherein the push rod can be mass-produced at an inexpensive cost.

To achieve the above object, according to the present invention, there is provided a process for producing a push rod, comprising the steps of: bringing one of the end faces of a rod body into pressure contact with a steel ball, and supplying an electric current between the rod body and the steel ball to perform an electric resistance welding of the rod body and the steel ball to each other, wherein a pipe material formed of an Al-Mg-Si based alloy is used as the rod body, the welding current I is set in a range of $18{,}000 \leqq I \leqq 21{,}000$ A, the pressing force P is set in a range of $350 \text{ kg f} \leqq P \leqq 400$ kg f, and the current supplying time t is set in a range of $t<2$ cycle.

In the past, it was difficult to weld the aluminum alloy and steel, and it was impossible to obtain a satisfactory welding strength. However, according to the above-described producing process, by specifying the material for the rod body as in the above-described manner, and by setting the welding current I, the pressing force P and the current supplying time as in the above-described ranges, it is possible to firmly bond the aluminum alloy and the steel. Thus, it is possible to mass-produce push rods at an inexpensive cost, the push rods being lightweight and having high bonding strength.

In this case, a strength of bonding between aluminum alloy and steel is equivalent to or exceeds a strength of bonding between steel and steel. It is considered that such an increase in bonding strength is attributable to the fact that a portion of the rod body easily bites into a surface of the steel ball, and such a biting-in portion exhibits an anchoring effect, and/or the fact that a liquid phase produced from the rod body exhibits a good wettability to the steel ball.

However, if the welding current I is smaller than 18,000 A, the bonding strength between the rod body and the steel ball is lowered, and the variation of the bonding strength is increased. On the other hand, if the welding current $I>21{,}000$ A, the bonding strength between the rod body and the steel ball is likewise lowered, and the electricity rate is increased. If the pressing force P is smaller than 350 kg f, the bonding strength is likewise low. On the other hand, if the pressing force P is larger than 400 kg f, there is a possibility that the pipe material may be buckled. If the current supplying time t is equal to or larger than 2 cycles, an intermetallic compound is liable to be formed in a bonded area between the rod body and the steel ball, resulting in a substantially lowered bonding strength.

BEST MODE FOR CARRYING OUT THE INVENTION

Figure 1:
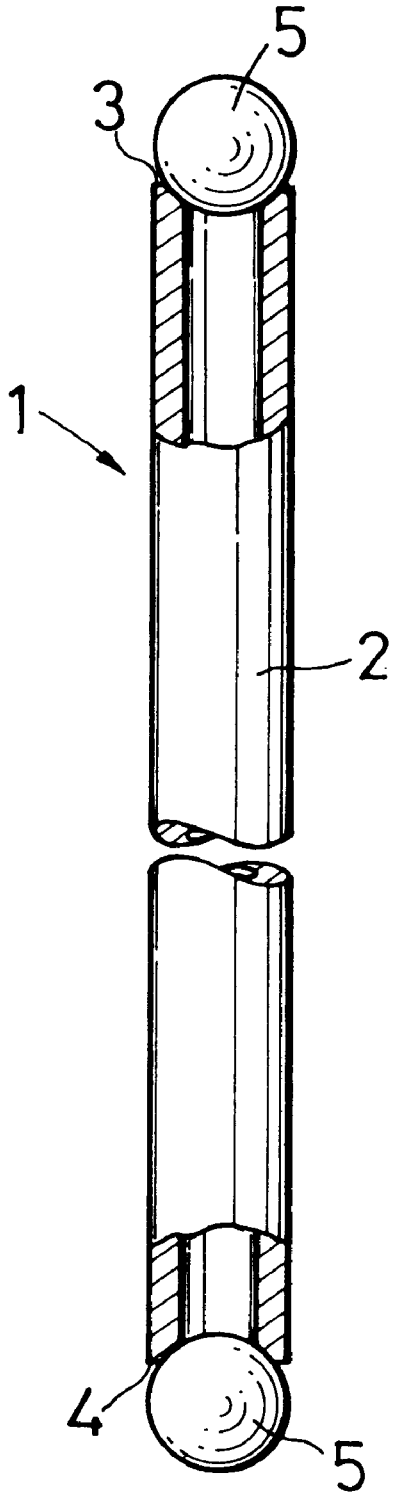
FIG. 1 is a partially broken-away front view of an essential portion of a push rod.

Referring to FIG. 1, a push rod 1 is used in a valve operating mechanism, a friction clutch and the like in an internal combustion engine, and includes a rod body 2, and a steel ball 5 bonded to at least one of end faces, e.g., to each of two end faces 3 and 4 (in the illustrated embodiment) of the rod body 2 by an electric resistance welding.

The rod body 2 is formed from a pipe material of an aluminum alloy. Aluminum alloys which may be used are malleable materials, i.e., 2000-series alloys (Al-Cu based alloys and Al-Cu-Mg based alloys), 3000-series alloys (Al-Mn based alloys), 4000-series alloys (Al-Si based alloys and Al-Si-Cu-Mg based alloys), 5000-series alloys (Al-Mg based alloys), 6000-series alloys (Al-Mg-Si based alloys) and 7000-series alloys (Al-Zn-Mg based alloys and Al-Zn-Mg-Cu based alloys). In order to inhibit weld cracks, it is preferable that the content of a metal having a solidification shrinkability such as Zn, Cu and the like in these alloys is smaller.

The push rod 1 having the rod body 2 formed from such a material is lightweight and lower in production cost, as compared with the prior art push rod.

Specially, if various respects of ambient-temperature strength, high-temperature strength, extrudability for producing a pipe material, electric resistance weldability and production cost for the push rod 1 are taken into consideration, an Al-Mg-Si based alloy which is 6000-series alloy, particularly, a 6061-T6 material is most suitable. If such a material is selected, it is possible to provide a strength of bonding between the rod body 2 and the steel ball 5 in the push rod 1, which is equivalent to or exceeds the conventional bonding strength. Such a push rod 1 can be used in a valve operating mechanism in an internal combustion engine for a vehicle to exhibit an excellent durability.

Figure 2:
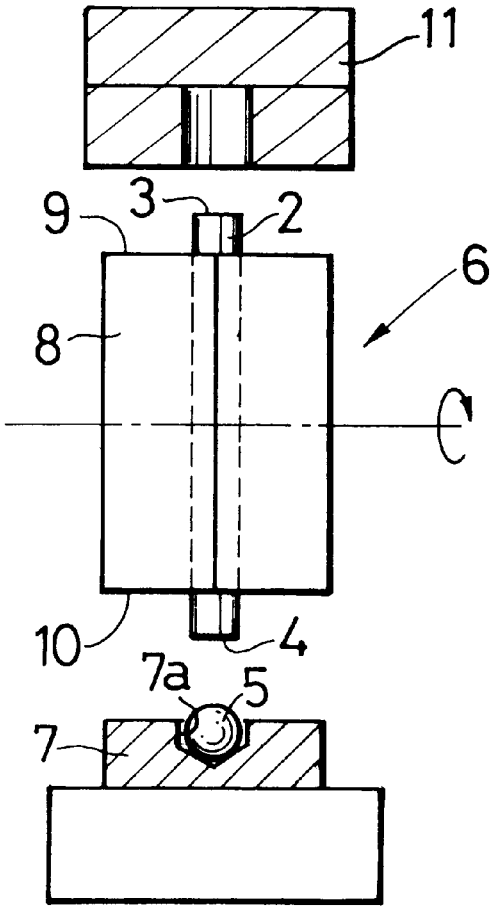
FIG. 2 is a partially broken-away front view of an essential portion an electric resistance welding machine.
Figure 3:
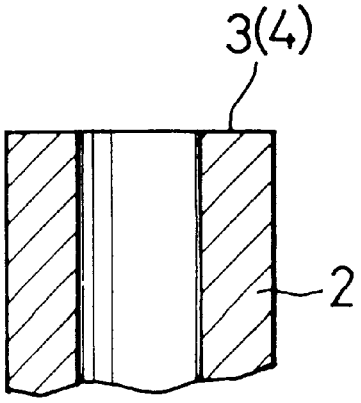
FIG. 3 is a partially broken-away front view of an essential portion of a rod body.

In producing the push rod 1, an A.C. electric resistance welding machine 6 shown in FIG. 2 is used, and the following steps are conducted sequentially.

(a) The steel ball 5 is placed into an upwardly turned recess 7*a* in a lower electrode 7.

(b) The rod body 2 is retained in a two-piece holder 8 which also serves as an upper electrode, such that opposite ends of the rod body 2 protrude from upper and lower end faces 9 and 10 of the holder, respectively.

(c) The holder 8 is lowered by a pressing member 11, so that one end face 4 of the rod body 2 is put into pressure contact with the steel ball 5 with a pressing force P, and electric current is supplied between the upper and lower electrodes 8 and 7 and thus between the rod body 2 and the steel ball 5, thereby performing an electric resistance welding of the rod body 2 and the steel ball 5 to each other.

(d) The pressing member 11 and the holder 8 are lifted, and the holder 8 is then rotated through 180° in a direction of an arrow (FIG. 2) within a vertical plane including an axis of the rod body 2, so that the other end face of the rod body 2 is turned downwardly. Then, the rod body 2 and the steel ball 5 are subjected to the electric resistance welding in a similar manner.

Particular examples will be described below.

A pipe material formed of a 6061-T6 material and having an outside diameter of 9 mm and a thickness of 2 mm was prepared as the rod body 2. In this case, the inner peripheral edge of the rod body 2 was square in section at each of the end faces 3 and 4 of the rod body 2 and was not subjected to a chamfering. A ball formed of a high-carbon/chromium bearing steel (JIS SUJ2) and having a diameter of 9 mm was prepared as the steel ball 5.

Various push rods 1 were produced by carrying out the similar electric resistance welding under conditions of a current supplying time t set at t=1 cycle (1/50 sec.), a pressing force P set at 330, 350 or 380 kg f, and welding current I varied in a range of 13,000 A≦I≦25,000 A.

Figure 4:
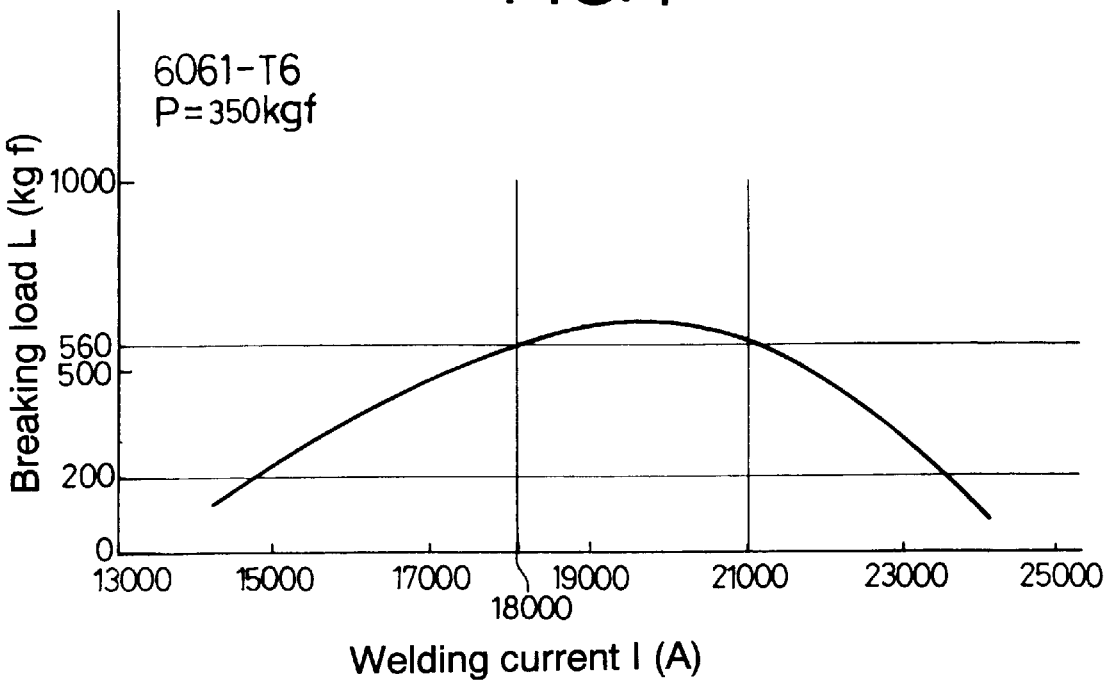
FIG. 4 is a graph showing the relationship between the welding current and the breaking load in a first example.
Figure 5:
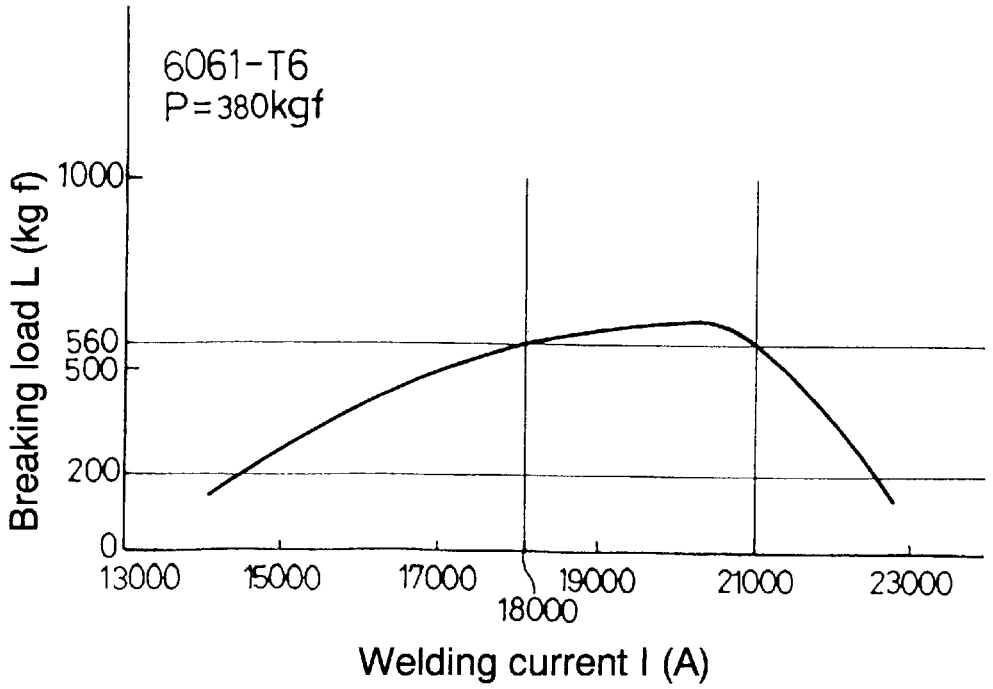
FIG. 5 is a graph showing the relationship between the welding current and the breaking load in a second example.
Figure 6:
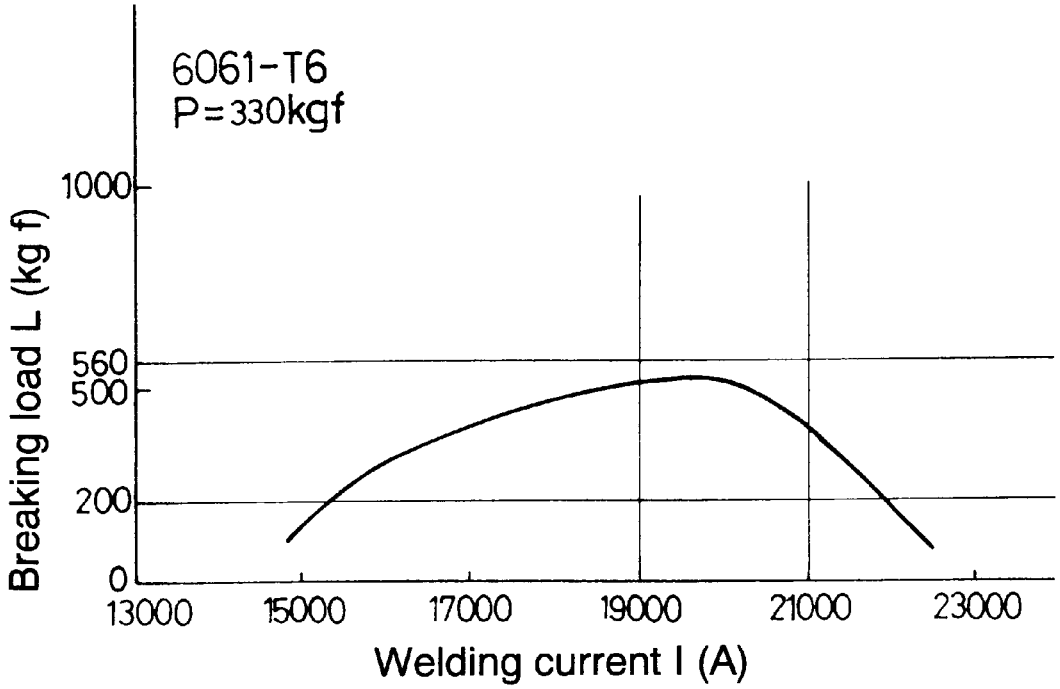
FIG. 6 is a graph showing the relationship between the welding current and the breaking load in a third example.

Then, the various push rods 1 were subjected to a static tensile and shear test to examine the relationship between the welding current I and the breaking load L, thereby providing results shown in FIGS. 4 to 6. For comparison, the breaking load L of a push rod (prior art article) including a rod body made of a pipe material of a stainless steel (JIS SUS304) was determined, thereby providing a result that L=560 kg f. As apparent from FIGS. 4 and 5, it can be seen that if the welding current I is set in a range of 18,000 A≦I≦21,000 A when the current supplying time t is of 1 cycle and the pressure force P is ≧350 kg f, the welding strength is equivalent to, or exceeds that of the prior art article.

As shown in FIG. 6, if the pressing force P is smaller than 350 kg f (P<350 kg f), the bonding strength is smaller than that of the prior art article.

Figure 7:
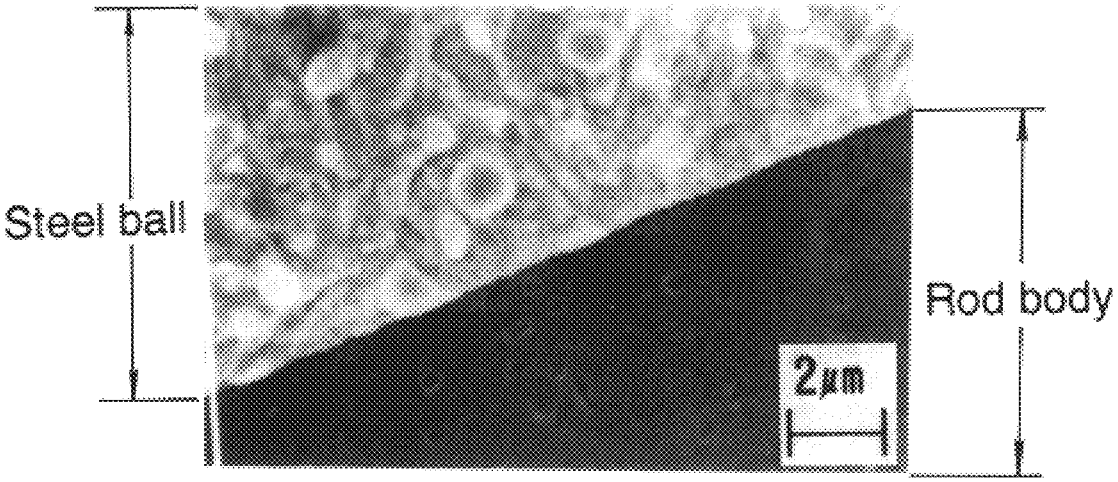
FIG. 7 is a photomicrograph showing the metallographic structure of a bonded area between the rod body and the steel ball after being welded.

FIG. 7 is a photomicrograph showing the metallographic structure of a bonded area between the rod body 2 and the steel ball 5. In this example, the welding current I was set at 20,000 A in FIG. 4. It can be seen from FIG. 7 that no AlFe intermetallic compound layer was formed in the bonded area.

Figure 8:
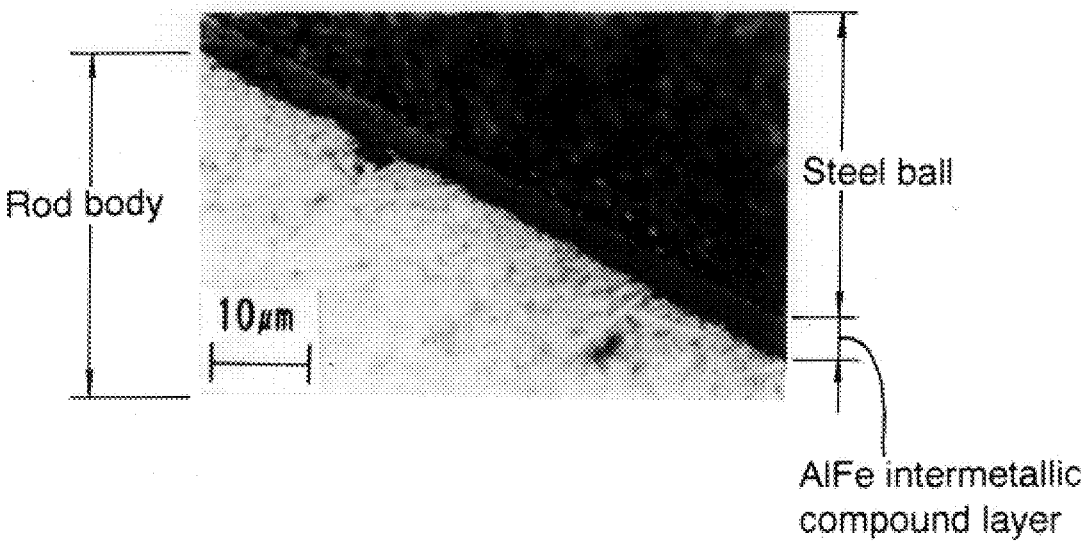
FIG. 8 is a photomicrograph showing the metallographic structure of a bonded area between the rod body and the steel ball after being subjected to a heating treatment.
Figures 9A, 9B:
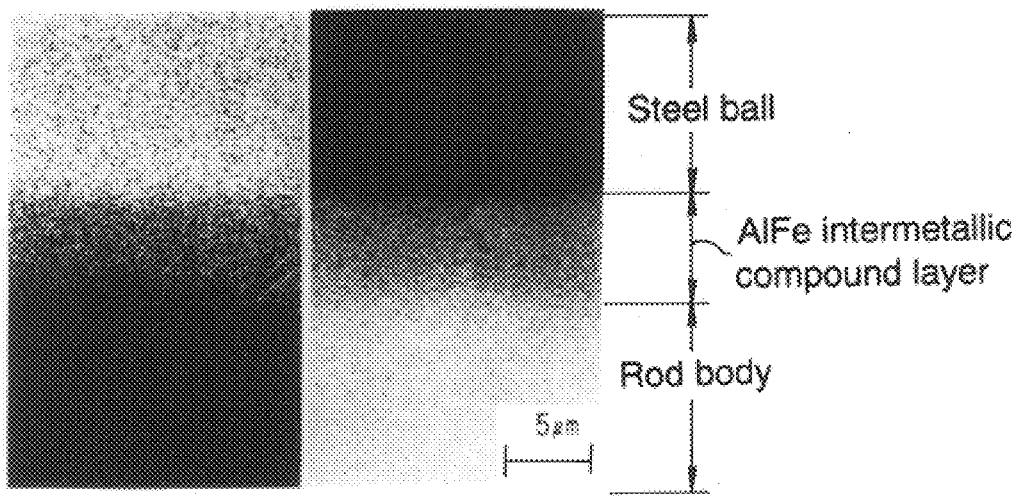
FIGS. 9(*a*) and 9(*b*) are X-ray analysis photograph of the bonded area between the rod body and the steel ball after being subjected to the heating treatment.
Figure 10:
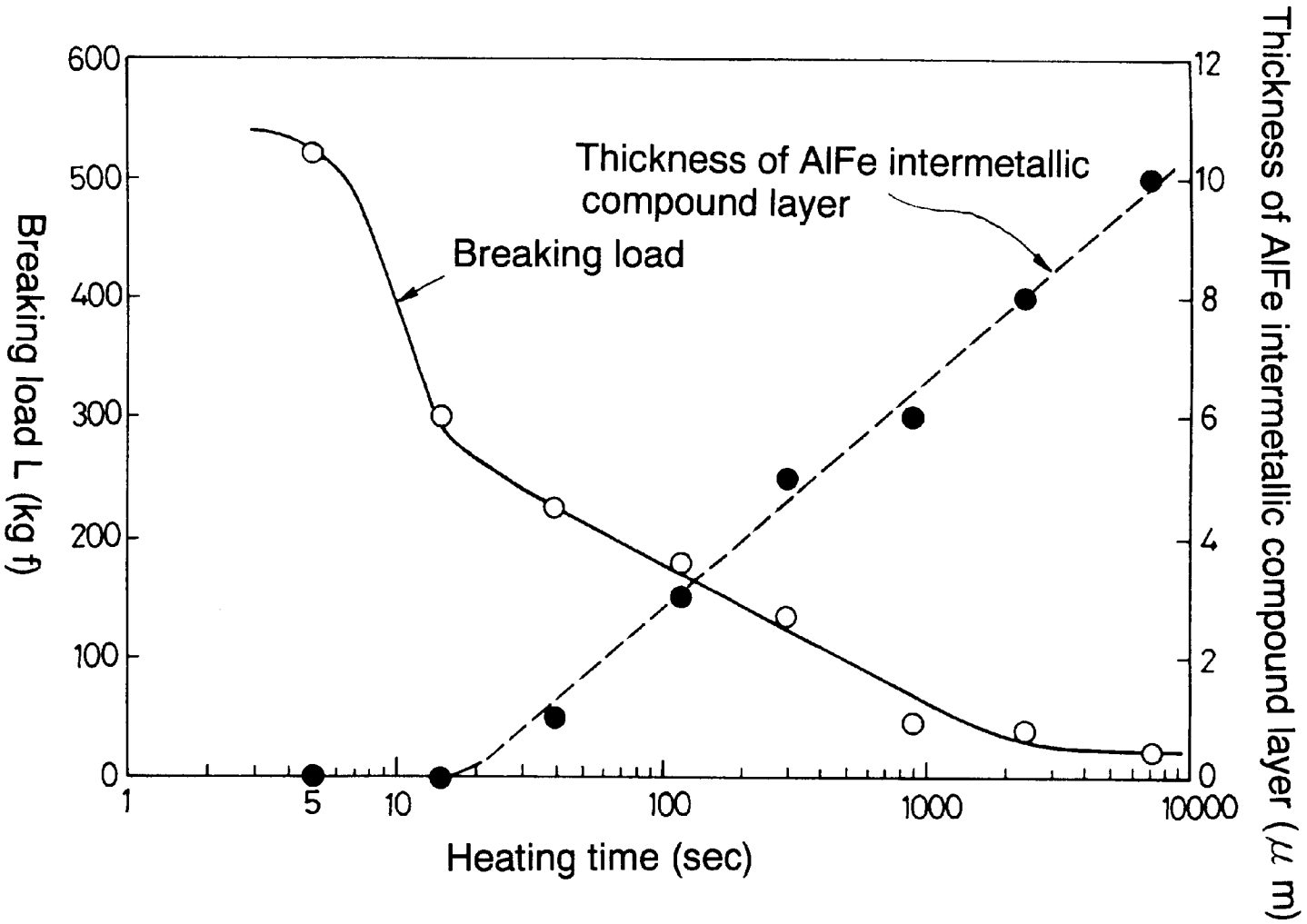
FIG. 10 is a graph showing the relationship between the heating time, the breaking load and the thickness of an AlFe intermetallic compound layer.

FIG. 8 is a photomicrograph showing the metallographic structure of a bonded area produced from a thermal treatment of the bonded area shown in FIG. 7 for 2 minutes at 580°. FIGS. 9(*a*) and 9(*b*) are X-ray analysis photograph of the bonded area, wherein FIG. 9(*a*) shows an Fe-K α ray image, and FIG. (*b*) shows an Al-K α ray image. It can be seen from FIGS. 8, 9(*a*), and 9(*b*) that an AlFe intermetallic compound layer was formed in the bonded area by the thermal treatment. FIG. 10 shows the relationship between the heating time, the breaking load L and the thickness of the AlFe intermetallic compound layer. As apparent from FIG. 10, if the heating time exceeds 5 sec., a sudden decrease in breaking load L is observed. It is believed that this is due to the formation of an AlFe intermetallic compound layer having a thickness so extremely small that it is difficult to measure, by the heating for a time exceeding 5 sec. If the heating time exceeds 15 sec, the thickness of the AlFe intermetallic compound layer is suddenly increased, and attendant on this, the breaking load L is decreased.

The heating time corresponds to the current supplying time t, and from this fact, the current supplying time t is set in a range of t<two cycles in order to avoid the formation of the AlFe intermetallic compound layer and to improve the productivity.

Figure 11:
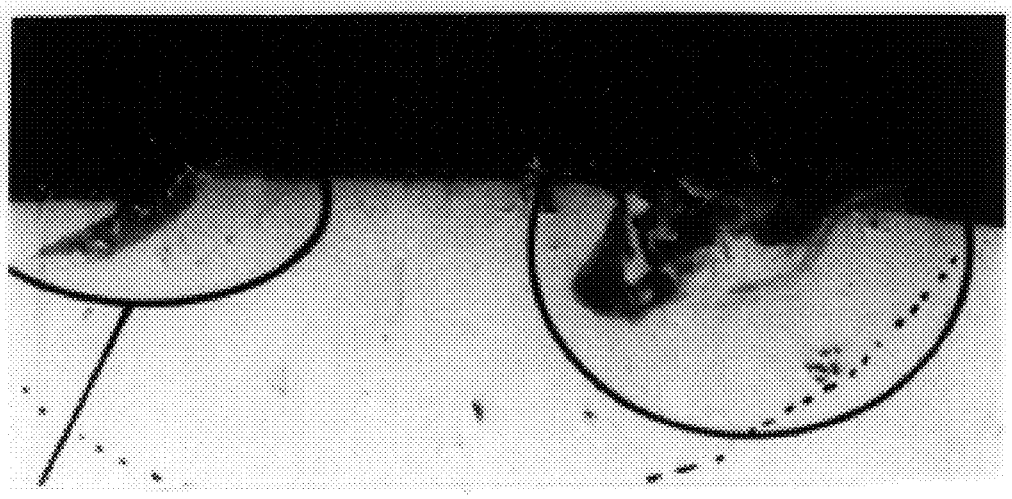
FIG. 11 is a photomicrograph showing the metallographic structure of a section of the steel ball after being subjected to a static tensile/shear test.
Figure 12:
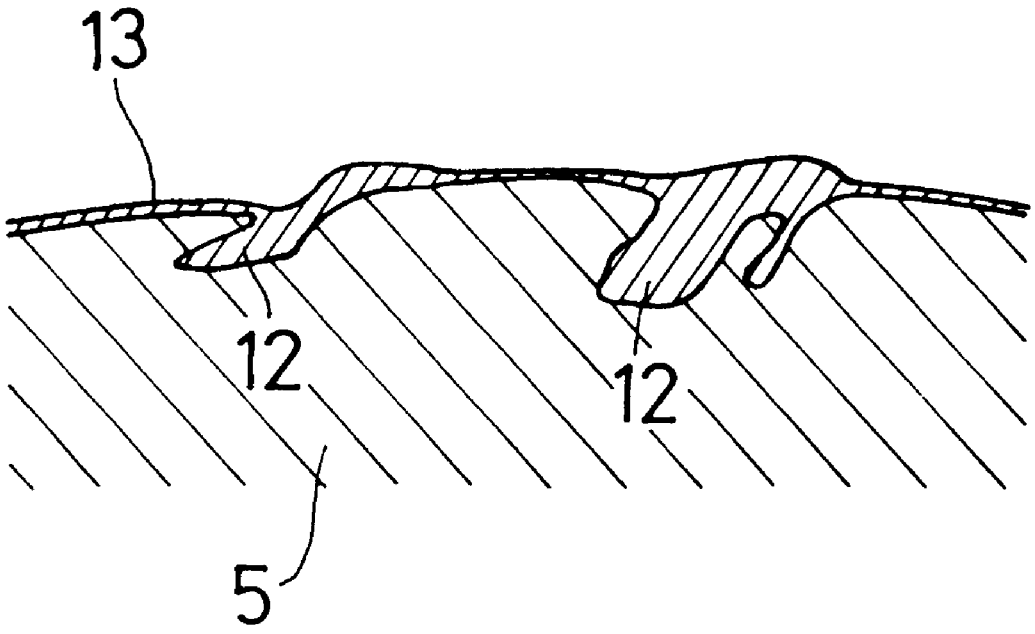
FIG. 12 is a tracing of the photomicrograph shown in FIG. 11.
Figure 13:
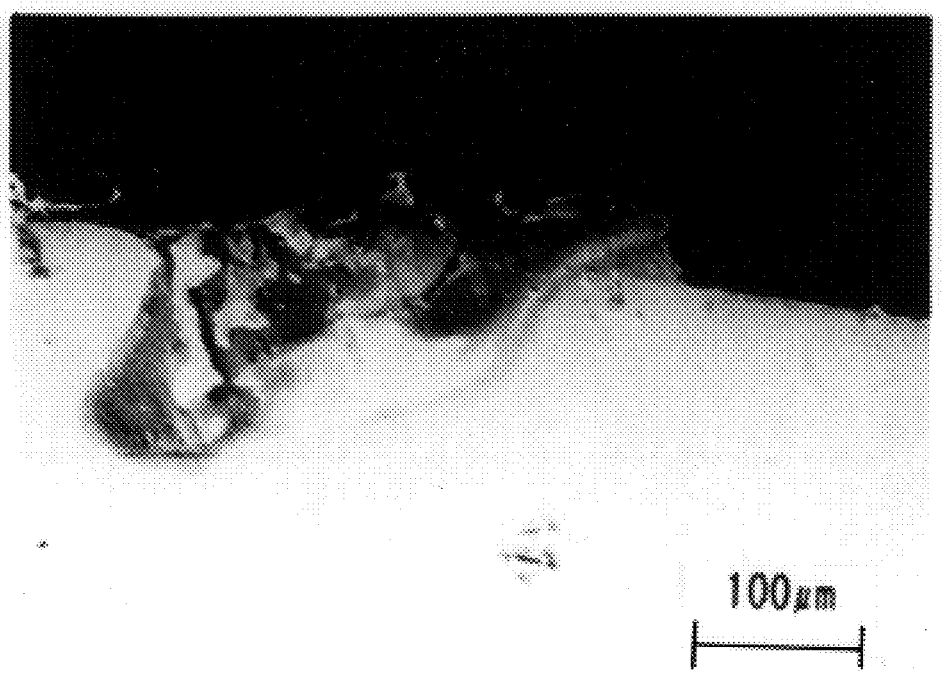
FIG. 13 is an enlarged photomicrograph of an essential portion of FIG. 11.
Figure 14A:
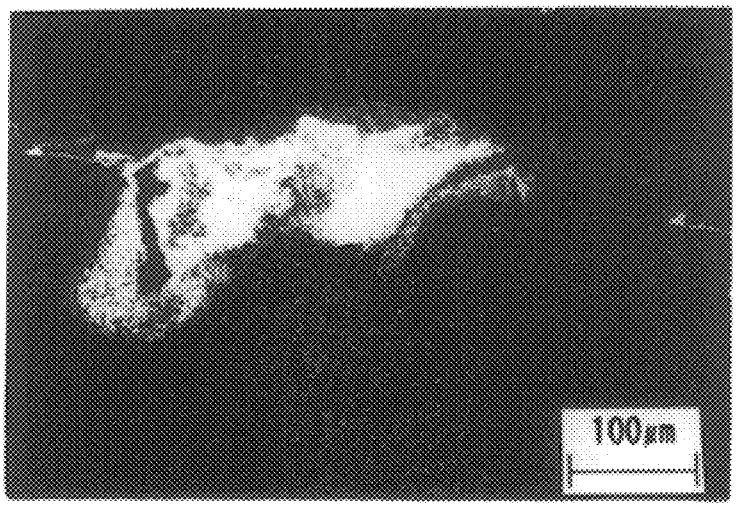
FIG. 14A is an X-ray analysis photograph of the section of the steel ball after being subjected to the static tensile/shear test, which shows an Al-K $\alpha$ ray image.
Figure 14B:
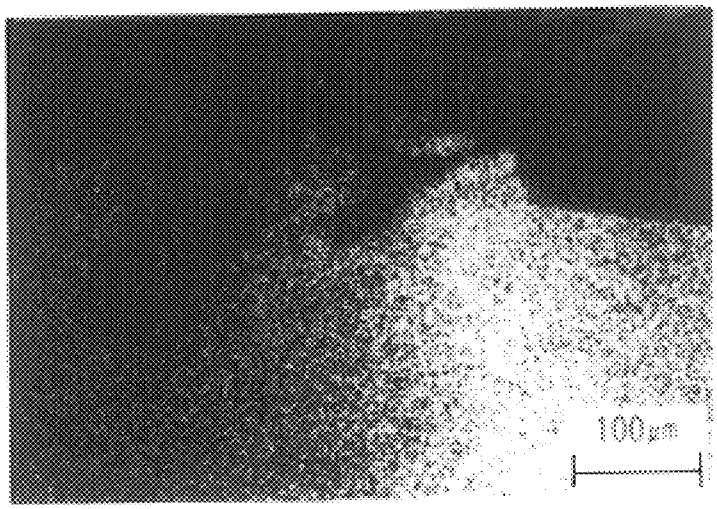
FIG. 14B is an X-ray analysis photograph of the section of the steel ball after being subjected to the static tensile/shear test, which shows an Fe-K $\alpha$ ray image.

FIG. 11 is a photomicrograph showing the metallographic structure of a section of the steel ball 5 after the static tensile/shear test; FIG. 12 is a tracing of FIG. 11; and FIG. 13 is an enlarged photomicrograph of an essential portion shown in FIG. 11. FIGS. 14A and 14B are X-ray analysis photographs of a section of the steel ball 5, FIG. 14 showing an Al-K α ray image, and FIG. 14B showing an Fe-K α ray image.

As apparent from FIGS. 11 to 13, the breaking was produced on the side of the rod body 2, and a portion of the rod body 2 bit into the surface of the steel ball 5 to form a large number of a biting-in portions 12. A thin Al layer 13 was also formed on the surface of the steel ball 5. This Al layer 13 is attributable to a good wettability of a liquid phase produced from the rod body 2. It is considered that an enhancement in bonding strength between the rod body 2 and the steel ball 5 is provided by an anchoring effect of such biting-in portions 12 and by the formation of the Al layer.

Figure 15:
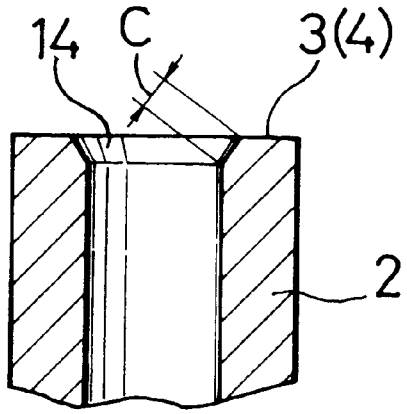
FIG. 15 is a vertical sectional front view of an essential portion of the rod body.

FIG. 15 shows the state of the rod body 2 resulting from the chamfering of the inner peripheral edge at end faces 3 and 4 of the rod body 2, wherein the length C of a bevel 14 of a chamfer is equal to 0.2 mm.

Using a rod body 2 having such a chamfer and formed from the same material into the same size as those described above and a steel ball formed from the same material into the same size as those described above, various push rods 1 were produced by conducting a similar electric resistance welding under the same conditions, except that the pressing force P was set at 330 kg f (P=330 kg f).

Figure 16:
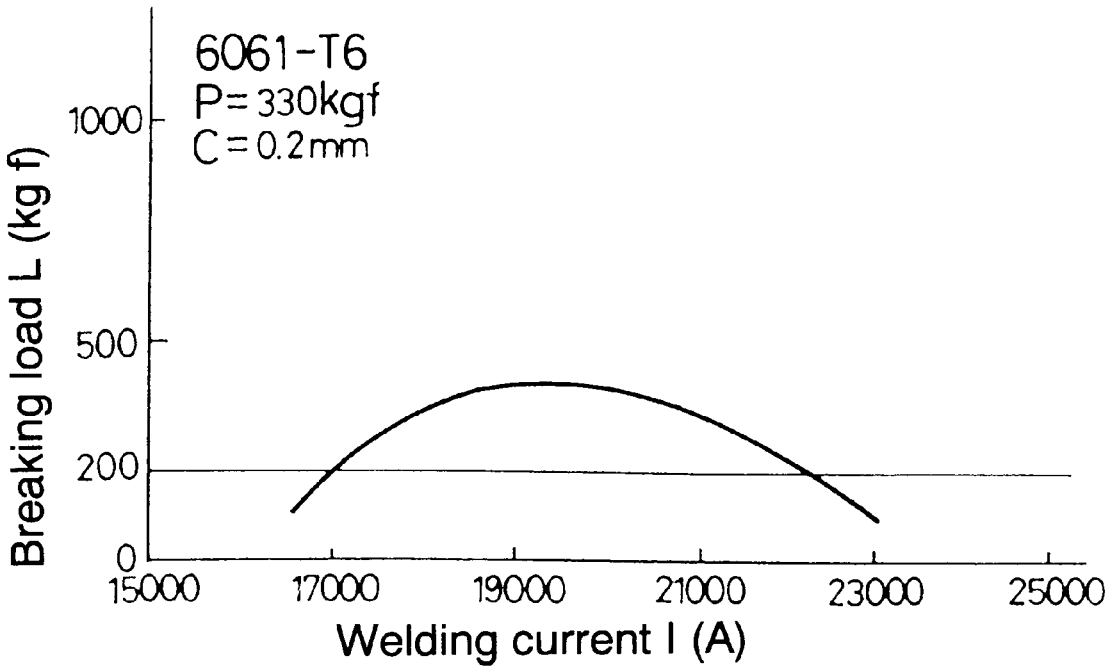
FIG. 16 is a graph showing the relationship between the welding current and the breaking load in a fourth example.

Then, the various push rods 1 were subjected to a static tensile/shear test to examine the relationship between the welding current I and the breaking load L, thereby providing results shown in FIG. 16.

From the comparison of FIG. 16 with FIG. 6 showing the graph taken when the rod body was not subjected to the chamfering, it can be seen that the bonding strength between the rod body 2 which was not subjected to the chamfering and the steel ball 5 is higher than the bonding strength between the rod body 2 subjected to the chamfering and the steel ball 5.

Figure 17:
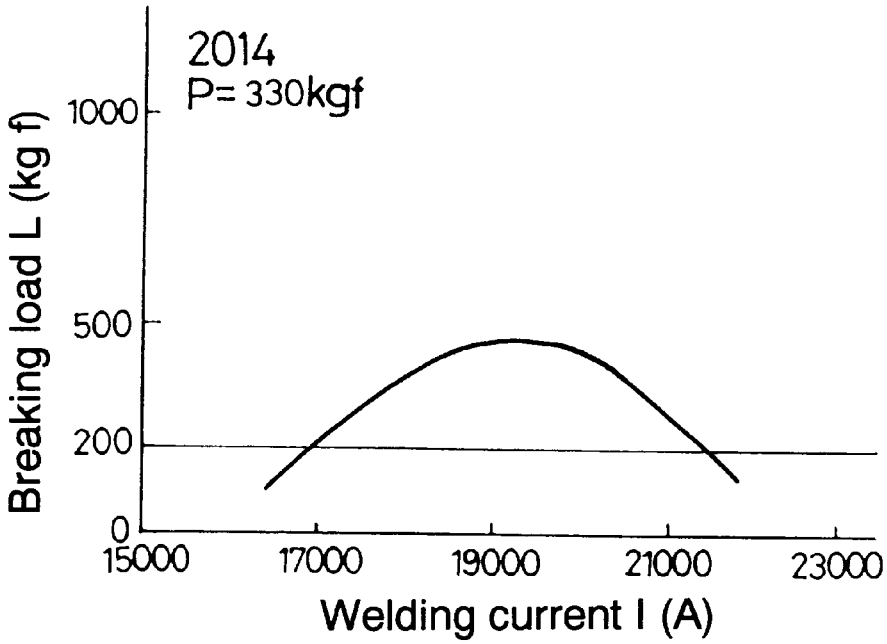
FIG. 17 is a graph showing the relationship between the welding current and the breaking load in a fifth example.
Figure 18:
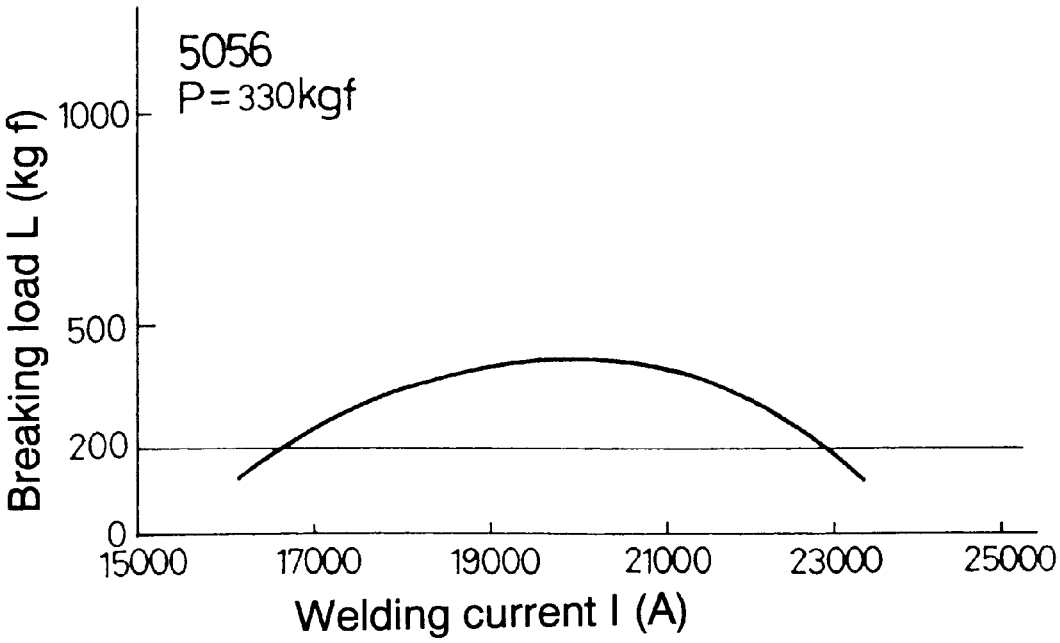
FIG. 18 is a graph showing the relationship between the welding current and the breaking load in a sixth example.

FIGS. 17 and 18 show the relationship between the welding current I and the breaking load L for other push rods 1. The example of FIG. 17 corresponds to the case where a pipe material of a 2014 material was used as the rod body 2, and the example of FIG. 18 corresponds to the case where a pipe material of a 5056 material was used as the rod body 2. The size of each of the rod bodies 2 is the same as that described above, and the material type for and the size of the steel ball 5 are the same as those described above. Further, the electric resistance welding conditions are the same as those described above, except that the pressing force P was set at 330 kg f.

When the bonding strength between the rod body 2 and the steel ball 5 is not as high as required for the push rod 1 in the internal combustion engine for the vehicle, as in a push rod 1 in a general-purpose internal combustion engine, the breaking load L between both of the rod body 2 and the steel ball 5 may be on the order of 200 kg f. If this respect is taken into consideration, materials other than the 6000-series alloys such as the 2014 material, the 5056 material and the like can be utilized as the material for the rod body 2.

Figure 19:
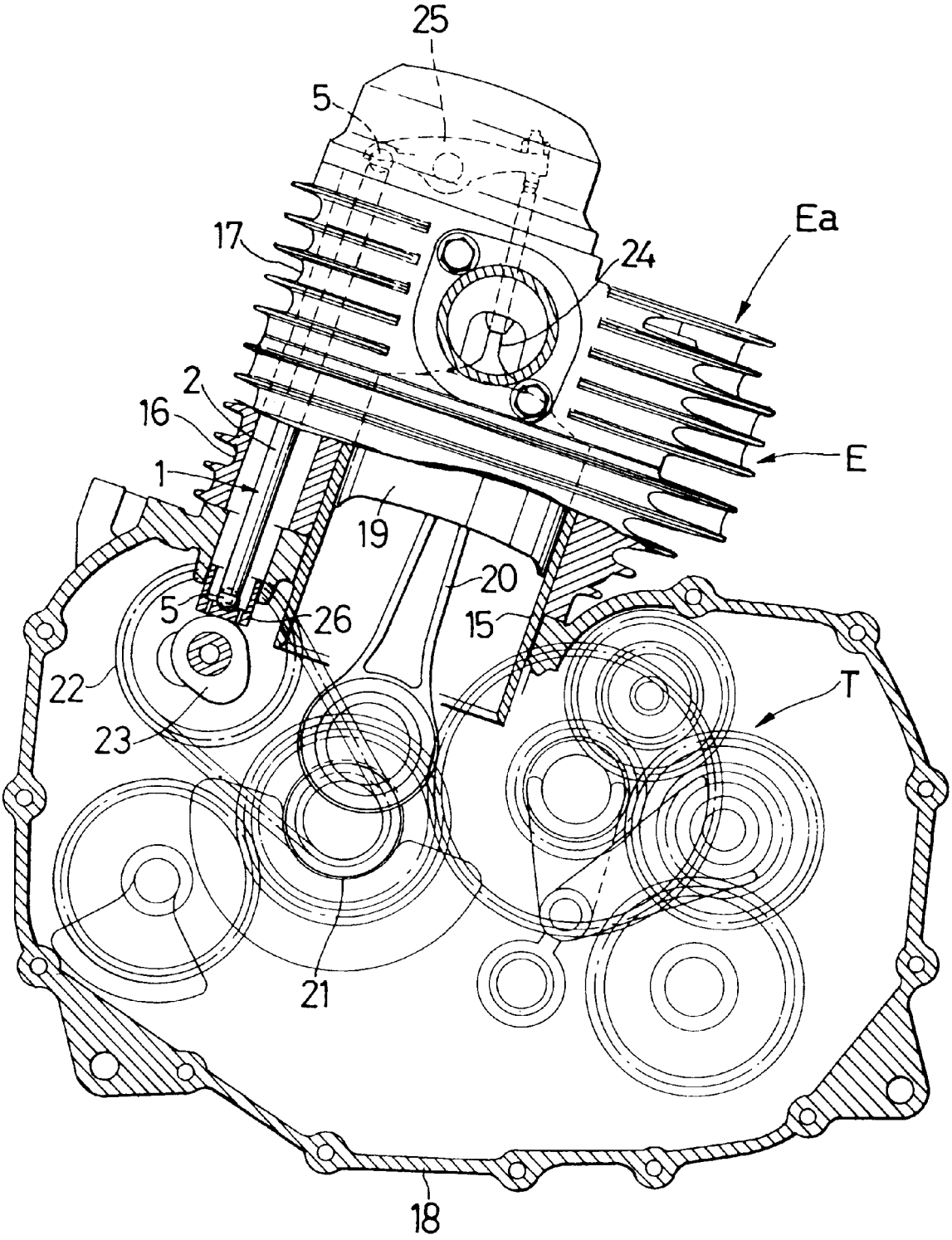
FIG. 19 is a partially broken-away front view of an essential portion of an internal combustion engine.

FIG. 19 shows the push rod 1 according to an embodiment of the present invention, which is applied to an internal combustion engine E for a vehicle. This internal combustion engine E includes a cylinder block 16 having a cylinder 15, a cylinder head 17 bonded to an upper end face of the cylinder block 16, a casing 18 bonded to a lower end face of the cylinder block 16 and also serving as a crank case and a transmission case of a transmission T, a piston 19 slidable within the cylinder 15, a crankshaft 21 connected to the piston 19 through a connecting rod 20, and a cam shaft 23 driven in a speed-reduced manner from the crankshaft 21 through a chain 22. The crankshaft 21 and the cam shaft 23 are supported in the casing 18. The cylinder head 17 is provided with intake and exhaust valves 24 for opening and closing intake and exhaust ports, and rocker arms 25 for opening and closing the intake and exhaust valves 24. The rocker arms 25 are driven by the cam shaft 23 through the push rod 1 and a tappet 26.

In the internal combustion engine E, an engine body Ea comprised of the cylinder head 17 and the casing 18 is formed from an aluminum alloy. In such a case, if the rod body 2 of the push rod 1 is formed from an aluminum alloy, linear expansion coefficients of the engine body Ea and the push rod 1 can be approximated to each other, thereby inhibiting a change in gap due to the temperature in the valve operating mechanism to reduce the striking sound.

Figure 20:
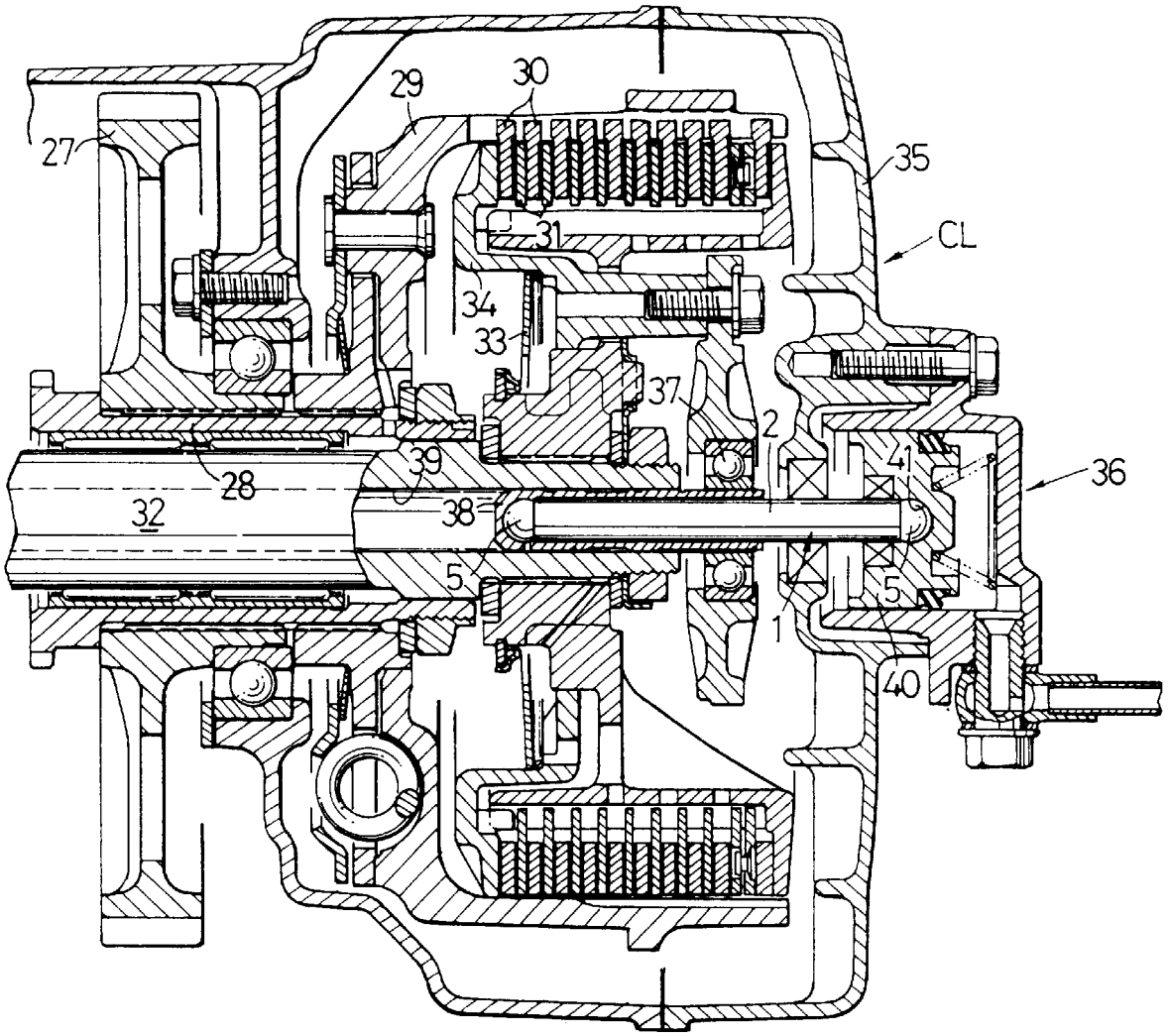
FIG. 20 is a vertical sectional front view of a multi-plate type friction clutch.

FIG. 20 shows the push rod 1 according to an embodiment of the present invention, which is applied to a multi-plate type friction clutch CL. This friction clutch CL is adapted to transmit a driving force from a driving gear 27 via a driving shaft 28, a clutch outer 29, clutch disks 30 and clutch plates 31 to a follower shaft 32. This transmitting of the driving force is achieved by bringing the clutch disks 30 into pressure contact with the clutch plates 31 by a clutch spring 33 through a pressure plate 34, i.e., bringing the friction clutch CL into its engaged state.

A hydraulic cylinder 36 is provided as clutch disengaging drive source in a casing 35. The pressure plate 34 has a bottomed sleeve 38 having an opened end supported on a bearing 37. The bottomed sleeve 38 is slidably received in a bore 39 in the follower shaft 32. One end of the push rod 1 abuts against a bottom surface of a recess 41 defined in the piston 40, and the other end of the push rod 1 is inserted into the bottomed sleeve 38 to abut against a bottom surface of the sleeve 38.

Thus, if the hydraulic cylinder 36 is operated, the pressure plate 34 is moved through the aid of the piston 40 and the push rod 1 to release the above-described pressure contact state, thereby disengaging the friction clutch CL.

What is claimed is:

1. A process for producing a push rod, comprising the steps of:

bringing one end face of a rod body into pressure contact with a steel ball;

supplying an electric current between said rod body and said steel ball to perform an electric resistance welding of said rod body and said steel ball to each other, wherein a pipe material formed of an aluminum-magnesium-silicon based alloy is used as said rod body, a welding current I is set in a range of $18{,}000 \leqq I \leqq 21{,}000$ amperes, a pressing force P is set in a range of 350 kilogram-force $\leqq P \leqq 400$ kilogram force and a current supplying time t is set in a range of $t < 2$ cycle; and bonding said rod body and said steel ball together by utilizing biting-in portions of the rod body into the steel ball and an aluminum layer formed on a surface of the steel ball by a liquid phase generated from the rod body during the welding.

2. A process according to claim 1, wherein said step of supplying electric current is stopped before substantial formation of an aluminum-iron intermetallic compound layer occurs.

3. A process according to claim 1, wherein said pipe material has an inner peripheral edge of a right angled cross section before it is subjected to said electric resistance welding.

* * * * *